US005224617A

United States Patent [19]

Gaudreault

[11] Patent Number: 5,224,617

[45] Date of Patent: * Jul. 6, 1993

[54] TAMPER EVIDENT CONTAINER

[75] Inventor: Mario Gaudreault, St-Damien, Canada

[73] Assignee: IPL, Inc., Bellechasse, Canada

[ * ] Notice: The portion of the term of this patent subsequent to May 12, 2009 has been disclaimed.

[21] Appl. No.: 788,922

[22] Filed: Nov. 7, 1991

Related U.S. Application Data

[63] Continuation-in-part of Ser. No. 591,775, Oct. 2, 1990, Pat. No. 5,111,954.

[51] Int. Cl.[5] ..... B65D 41/32

[52] U.S. Cl. ..... 220/266; 220/214; 220/260; 220/306; 220/756; 220/771; 220/775; 206/519

[58] Field of Search ..... 220/265, 266, 268, 306, 220/94 R, 94 A, 214, 657, 659, 756, 770, 771, 775; 206/499, 505, 506, 510, 515, 519

[56] References Cited

U.S. PATENT DOCUMENTS

| | | | |
|---|---|---|---|
| 3,586,200 | 6/1971 | Kramer et al. | 220/94 R |
| 3,756,451 | 9/1973 | Popeil | 220/94 R X |
| 3,811,597 | 5/1974 | Frankenberg et al. . | |
| 4,293,073 | 10/1981 | Yates, Jr. . | |
| 4,296,871 | 10/1981 | Andersson . | |
| 4,362,253 | 12/1982 | Wortley et al. . | |
| 4,422,559 | 12/1983 | Landis . | |
| 4,711,364 | 12/1987 | Letica . | |
| 4,763,732 | 8/1988 | Neal . | |
| 4,787,530 | 11/1988 | Edwards . | |
| 4,821,910 | 4/1989 | Poirier | 220/266 |
| 4,934,554 | 6/1990 | Edwards . | |
| 4,998,622 | 3/1991 | Drack . | |
| 5,027,969 | 7/1991 | Lesquir | 220/270 |
| 5,040,695 | 8/1991 | Adams et al. | 220/270 |
| 5,088,615 | 2/1992 | Neuman | 220/95 |

FOREIGN PATENT DOCUMENTS

| | | |
|---|---|---|
| 85118 | 2/1958 | Denmark . |
| 2416170 | 8/1979 | France . |
| 720135 | 12/1954 | United Kingdom . |

*Primary Examiner*—Gary E. Elkins
*Assistant Examiner*—Stephen Cronin
*Attorney, Agent, or Firm*—Longacre & White

[57] ABSTRACT

A container adapted to securely engage a cover displaying a peripheral depending skirt comprises a body with side walls having an upper edge portion adapted to engage the skirt of the closure. The side walls include a peripheral inverted L-shaped flange. Integrally formed with the flange on two sides of the container is a downward projection including a frangible tab which must be broken to remove the cover from the container; however, the broken tabs do not hinder the reclosure of the container, nor the handling of the container. The side projections are so shaped as to allow similarly constructed containers to be nested one into the other.

9 Claims, 6 Drawing Sheets

TAMPER EVIDENT CONTAINER

RELATED INVENTION

This is a continuation-in-part application of U.S. patent application Ser. No. 591,775 filed Oct. 2, 1990 now U.S. Pat. No. 5,111,954.

FIELD OF THE INVENTION

The invention relates to a container adapted to securely engage a cover and equipped with frangible tabs, the breaking of which will indicate that the closed container has been tampered with and, also, will allow the cover to be easily lifted from the container.

BACKGROUND OF THE INVENTION

Containers having a tamper-proof feature have become an important item of commerce. Generally, these tamper-proof assemblies comprise a cover with a tab attached to one part of the assembly by a breakable web. Often, the tab is broken simply by the act of opening the container, i.e. removing the cover. one such assembly may be found described in U.S. Pat. No. 4,362,253 issued Dec. 7, 1982 to Wortley et al.

OBJECTS AND STATEMENT OF THE INVENTION

It is an object of the present invention to provide, on a container which is adapted to securely engage a cover, an integrally formed side wall flange including frangible tab means which must be broken in order to have access to the cover's peripheral edge in order to remove or lift the cover from the container.

A close relationship is defined between the flange and the depending skirt of the cover thus rendering difficult the insertion of fingers or prying tools between the skirt and the flange for lifting the cover from the container. Authorized removal of the cover from the container is accomplished by breaking the tab means on the flange to subsequently facilitate the manual grasping of the skirt's lower edge and subsequently disengage the cover from the container.

The present invention therefore relates to a container adapted to securely engage a cover displaying a peripheral dependent skirt which comprises:

- a body including side walls having an upper edge portion adapted to engage the peripheral depending skirt of the cover; the side walls include a peripheral flange consisting of a horizontal portion projecting outwardly from the side wall and of an outer vertical portion distanced from the side wall; these portions receive in close relationship therewithin a lower part of the skirt; and
- a pair of opposite side projections each having a horizontal portion integrally formed with the side wall and with the horizontal portion of the flange, and a downwardly extending vertical portion integrally formed with the vertical portion of the flange; tab means on the side projections are connected at least to the vertical portion of the flange through weakened areas to thereby render the tab means breakable when pressure is applied thereon, thus providing visual indication of tampering, whether authorized or unauthorized, and allowing removal of the cover from the container.

In one form of the invention, the tab means have a horizontal portion slightly distanced from the side wall of the container.

In another form of the invention, the side projections are constructed in a manner that similarly constructed containers can be nested one into the other. The lower edges of the side projections are thus shaped with recessed areas to respectively receive the flange and the upper portion of the container wall.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 2:
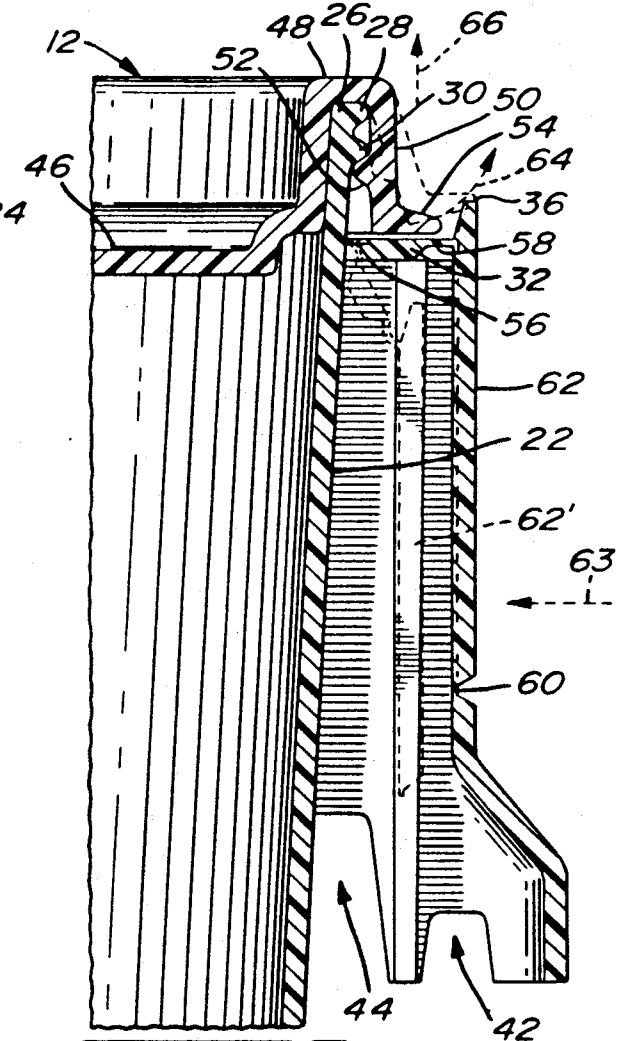
FIG. 2 is a cross-sectional view taken along lines 2—2 of FIG. 1.
Figure 1:
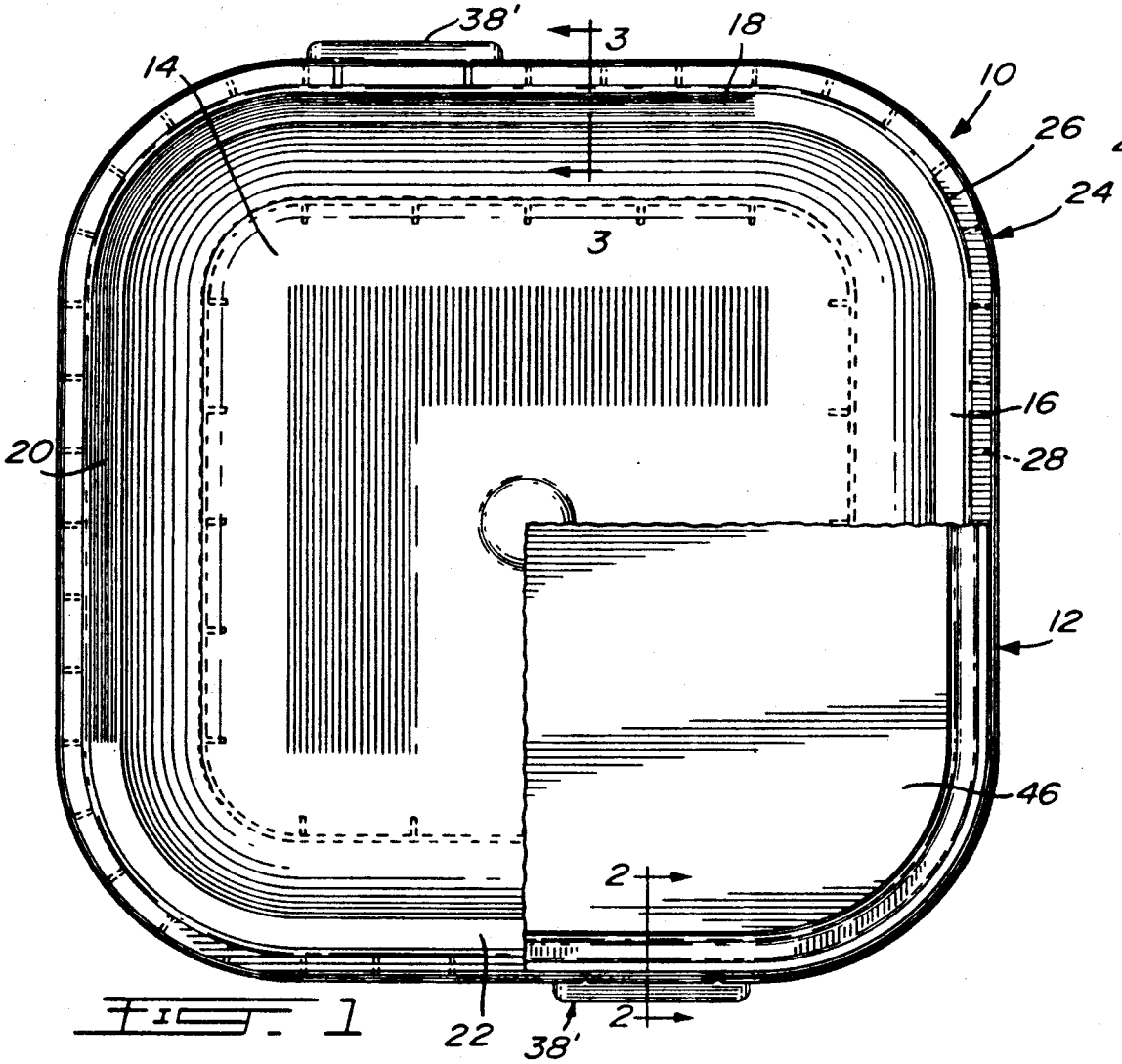
FIG. 1 is a top plan view of a container made in accordance with the present invention showing part of a cover thereon.

Referring to FIG. 1, there is shown a container, generally denoted 10, adapted to securely engage a cover, generally denoted 12. The container has a bottom wall 14 and four slightly inclined side walls 16, 18, 20 and 22. The four side walls display a continuous peripheral flange, generally denoted 24, having an inverted L-shape and disposed slightly lower than the upper edge portion 26 of the side wall. The flange is integrally formed with the side walls and includes peripherally spaced triangular shaped reinforcing ribs 27 therebeneath. As illustrated in FIG. 2, the peripheral upper edge portion 26 of the side walls displays a pair of vertically spaced circumferential beads 28 and 30.

Figure 3:
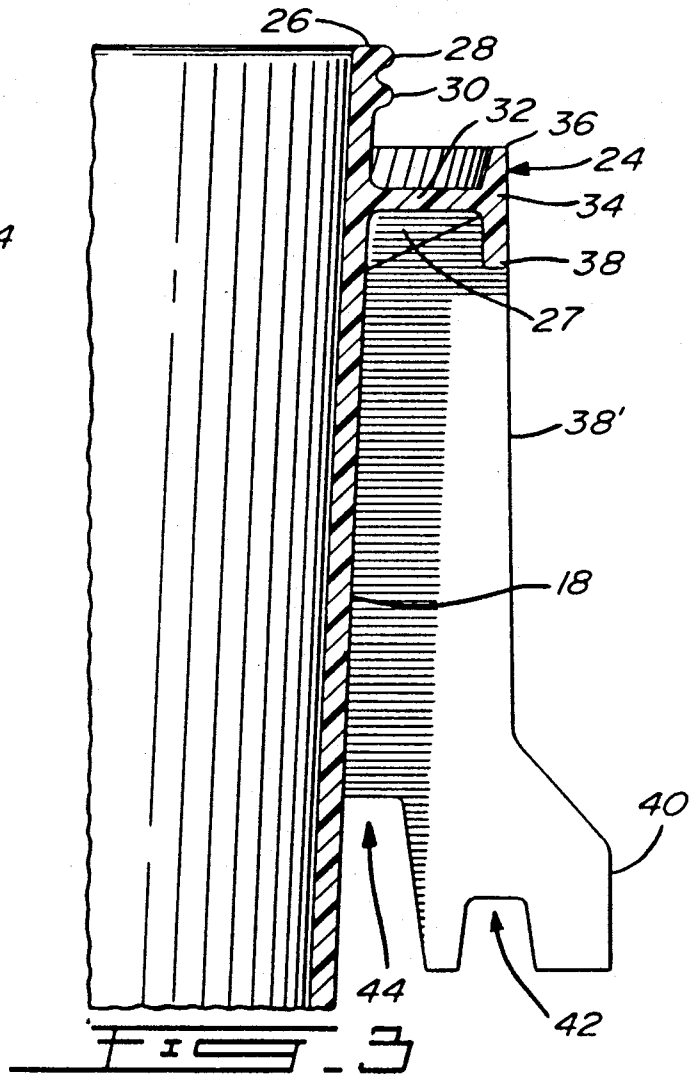
FIG. 3 is a cross-sectional view taken along lines 3—3 of FIG. 1.
Figure 4:
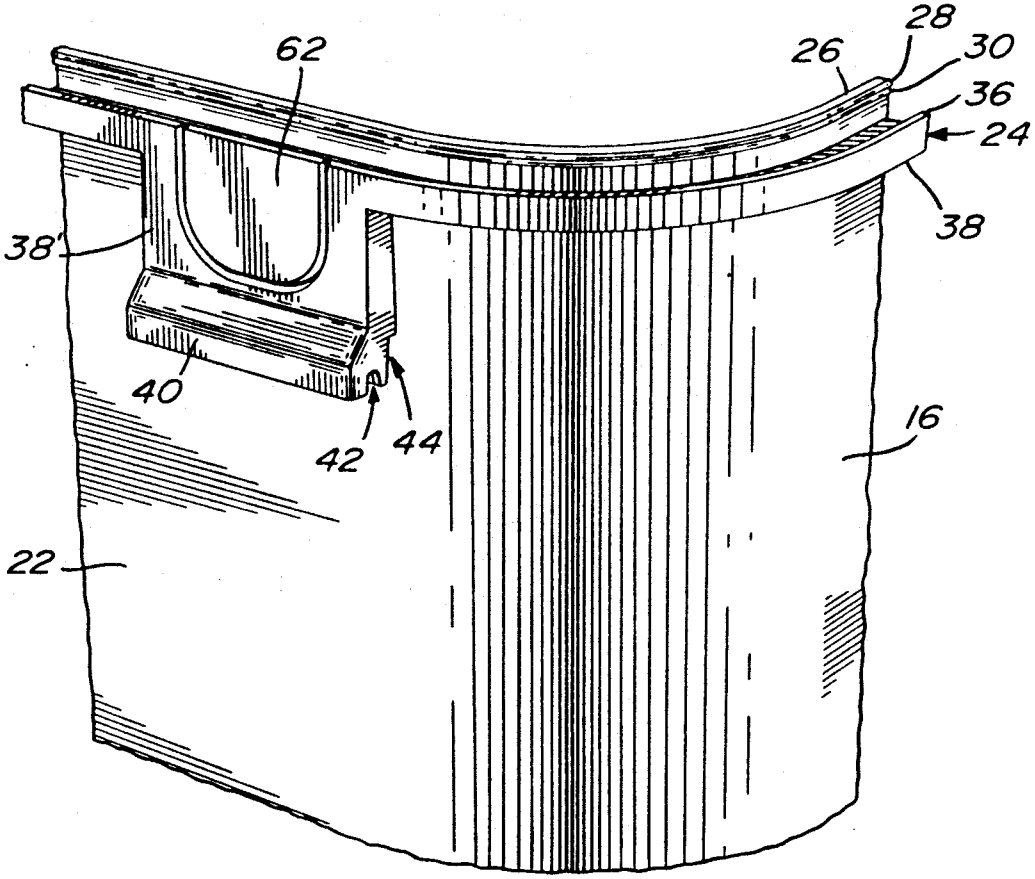
FIG. 4 is a perspective view showing one corner area of the container of the present invention.
Figure 5:
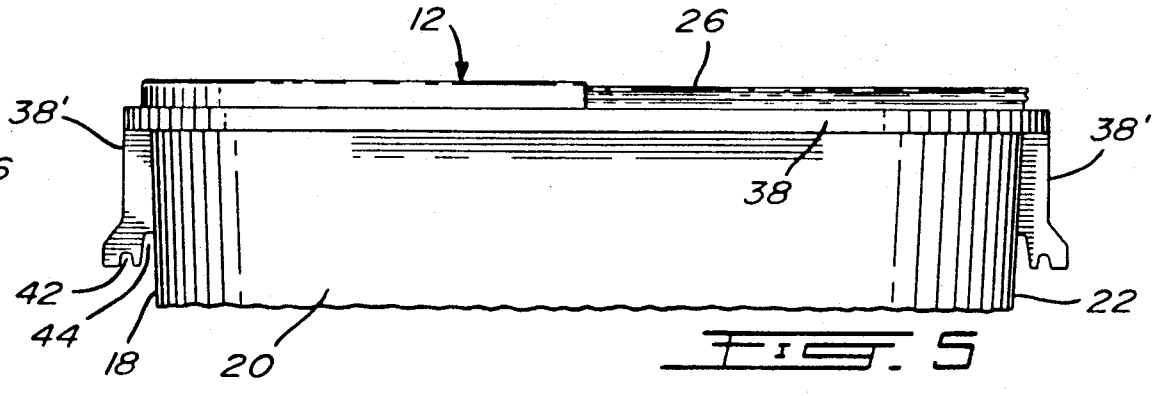
FIG. 5 is a side elevational view showing the upper part of the container with the partly broken-away cover thereon.

Referring to FIGS. 2, 3 and 4, the peripheral flange 24 consists of a horizontal portion 32 having one end integral with the side wall of the container and the opposite end terminating in a vertical portion 34 displaying an upper extension 36 and a lower extension 38.

On two opposite sides of the container, the flange 24 has downwardly extending enlarged areas 38' defining handles. As can be seen in FIG. 4, these handles have a general rectangular shape with a frontwardly projecting lower portion 40, the lower edge of which displays, on the opposite narrow sides thereof, a pair of recessed areas 42 and 44, the function of which will be described hereinbelow. The outer recessed area 42 is in vertical alignment with the upper portion 36 of the flange while the inner recessed area 44 is in vertical alignment with the upper edge portion 26 of the container.

As shown in FIGS. 1 and 2, the cover 12 has a flat central surface 46 and an inverted U-shaped peripheral edge 48 displaying a depending skirt 50 having a circumferential inner bead 52 and a flat outwardly projecting lower edge 54. This lower edge is confined within the recessed area defined by the upper edge portion 26, the horizontal portion 32 of the flange and the upper vertical extension 36. The material of the cover is preferably an injection moulded plastic so that the skirt 50 may be somewhat flexed to be forced into snap engagement with the peripheral upper edge portion 26 of the container with bead 52 engaging underneath bead 30.

In the handle area of the flange, the horizontal portion has a first line of reduced thickness, such as illustrated at 56, in order to make the material frangible along that line (horizontal portion 32 has also a further line 58 of reduced thickness to render the material bendable). Similarly, the front face of the handle has a U-shaped outline 60 of reduced thickness, thus defining a tab 62 (see FIG. 4).

As illustrated in FIG. 2, to remove the cover securely engaged with the container, one must press on the tab 62 in the direction of arrow 63 to force it inwardly within the cavity defined behind the handle, as shown by dotted lines 62'. In this position, the lower edge 54 of the cover skirt may be manually grasped to be lifted in the direction of arrow 64 to remove the cover, as illustrated by arrow 66.

It is recognized that it may be possible to insert a prying tool between edge 54 and the flange (on side wall 20 for example) to remove carefully the cover without breaking the tabs. However, this is extremely difficult due to the close confinement of the skirt edge 54 rearwardly of the flange's upper portion 36.

Figure 6:
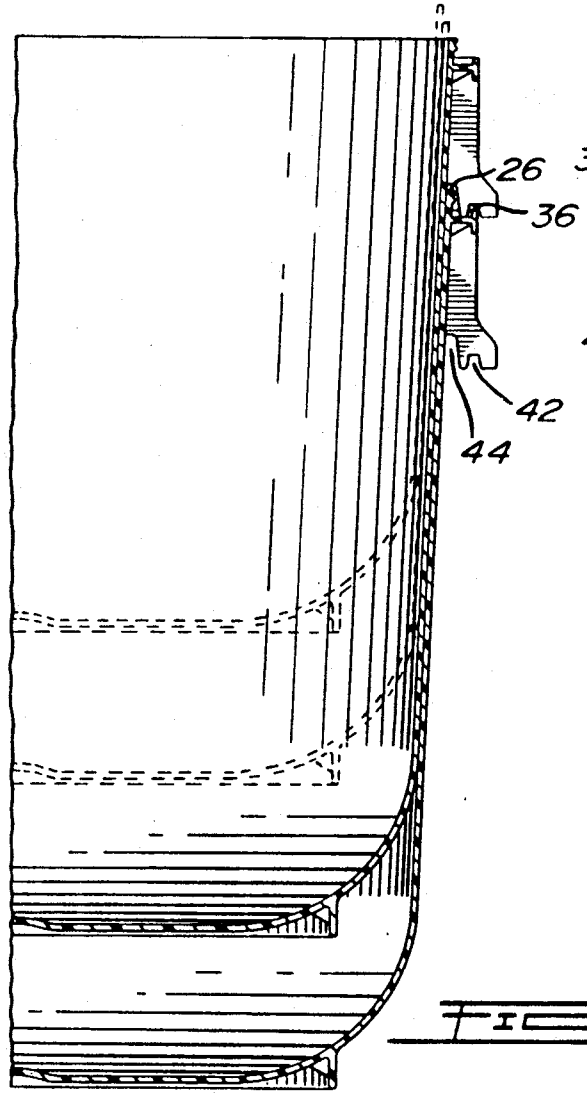
FIG. 6 is a partial cross-sectional view of similarly constructed containers made in accordance with the present invention in a nested engagement.

Referring to FIG. 6, two similarly constructed containers made in accordance with the present invention are shown to illustrate the function of recesses 42 and 44 which are adapted to respectively receive the upper portion 36 of the flange and the upper portion 26 of the container's side wall. Hence, nested containers are supported by the two handles 38' on the opposite sides of the container, and not on the inner faces of the side walls of the container.

Figure 7:
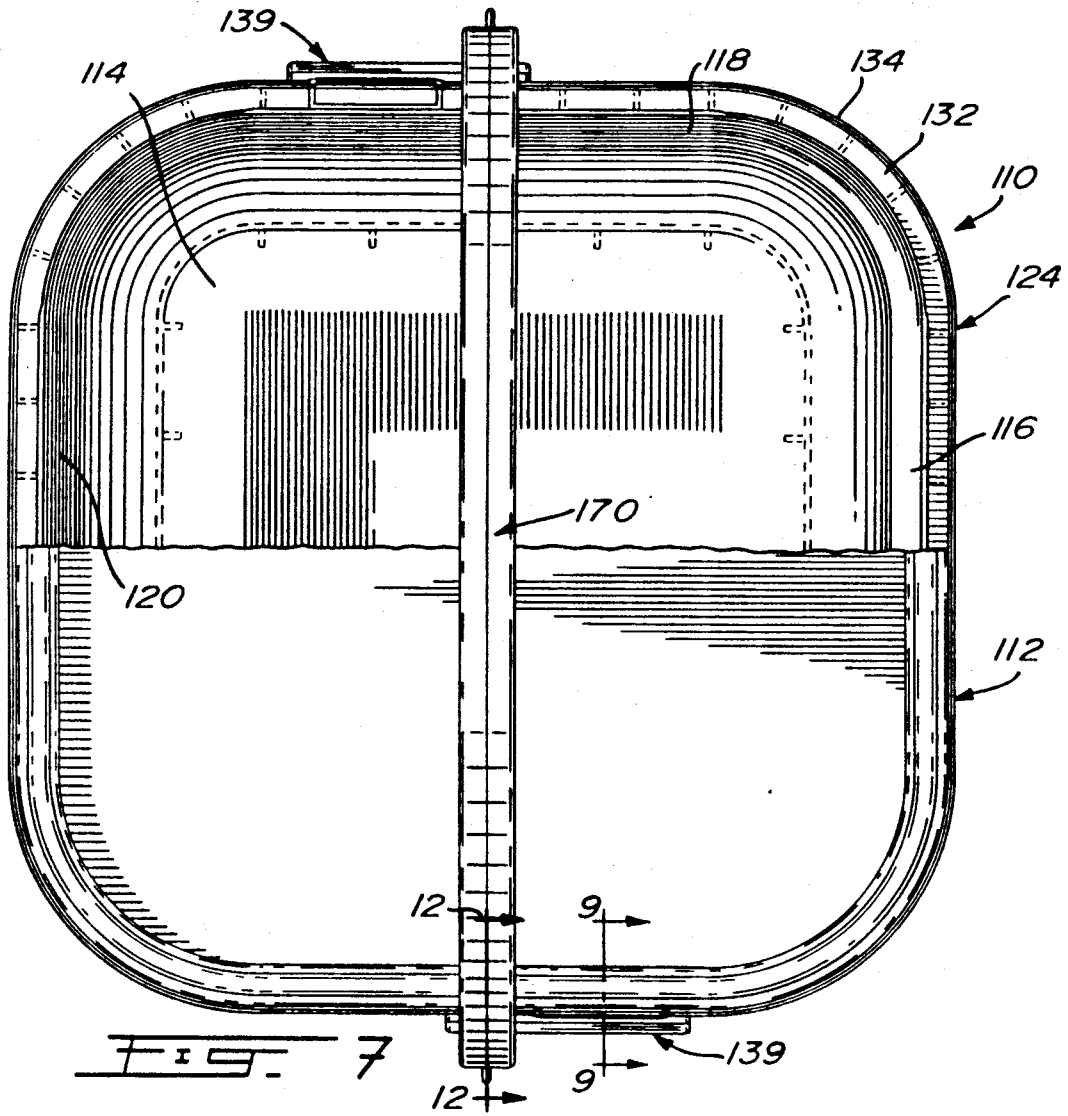
FIG. 7 is a top plan view of an other embodiment of a container made in accordance with the present invention showing part of a cover thereon.
Figure 8:
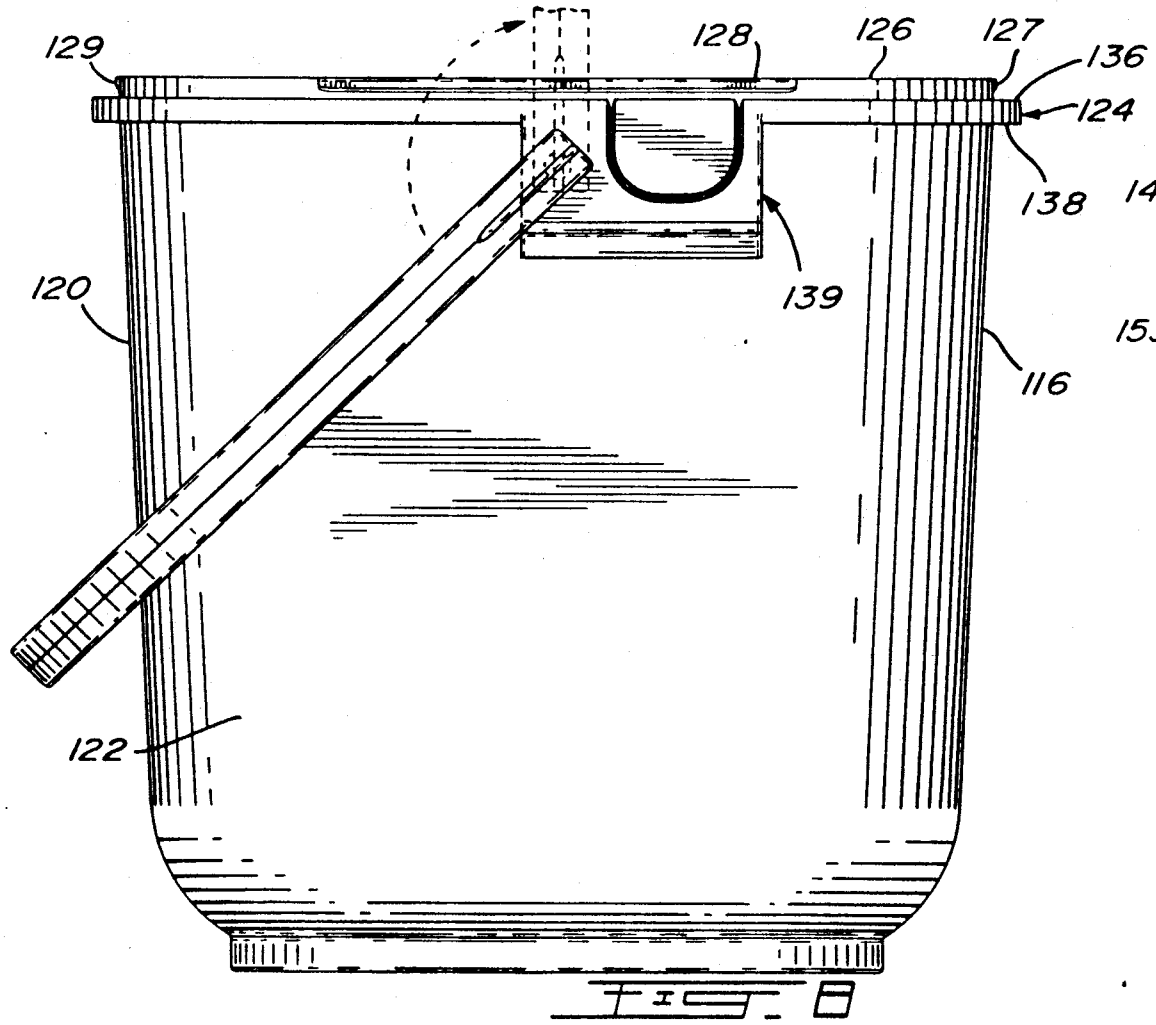
FIG. 8 is as side elevation view thereof without the cover.

Referring to FIGS. 7 and 8, there is shown another embodiment of a container, generally denoted 110, adapted to securely engage a cover, generally denoted 112. The container has a bottom wall 114 and four slightly inclined side walls 116, 118, 120 and 122. The four side walls display a continuous peripheral flange, generally denoted 124, having an inverted L shape and disposed slightly lower than the upper edge portion 126 of the side walls. The flange is integrally formed with the side walls. As illustrated in FIG. 8, the peripheral upper edge 126 displays, on part thereof, a bead 128. Similar beads are provided on the other side walls, two of which are shown as 127 and 129 at the upper edge of respective side walls 116 and 120.

Referring to FIG. 7, the peripheral flange 124 consists of a horizontal portion 132 having one end integral with the side wall of the container and the opposite end terminating in a vertical portion 134 displaying an upper edge 136 and a lower edge 138 (see FIG. 8).

On two opposites sides of the container, the flange 124 is integral with a downwardly extending projection 139. Each opposite side projection 139 has a general rectangular shape with a frontwardly projecting lower portion 140, the lower edge of which displays, on opposite narrow sides thereof, a pair of recessed areas 142 and 144 (see FIG. 9). The outer recessed area 142 is in vertical alignment with the upper portion 136 of the flange while the inner recessed area 144 is in vertical alignment with the upper edge portion 126 of the container. Thus, two similarly constructed containers made in accordance with the present invention may be nested in a manner similar to the two similarly constructed containers illustrated in FIGS. 1-6.

Figure 9:
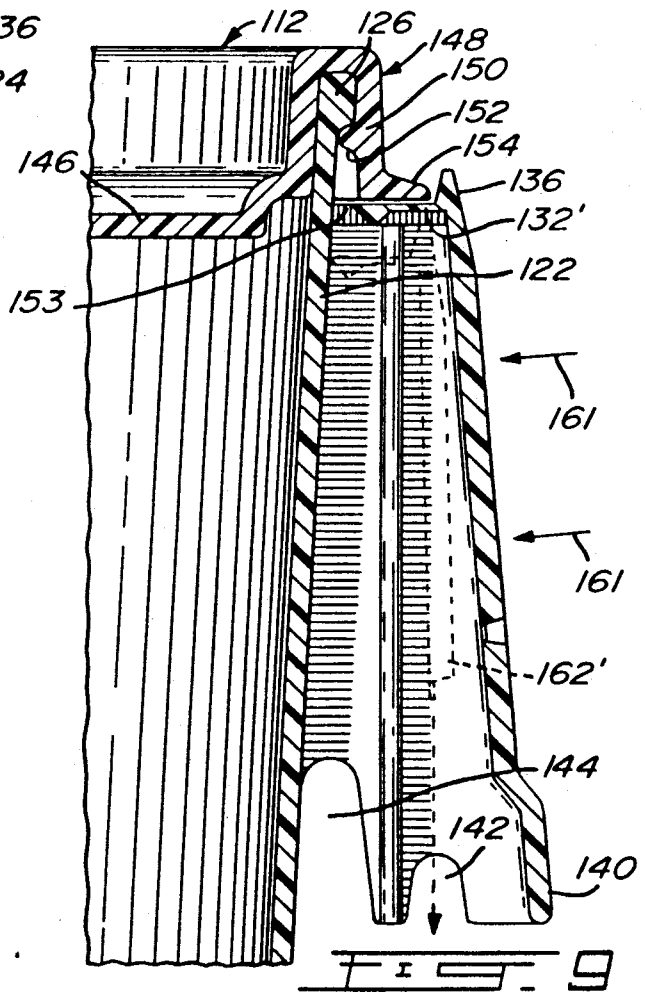
FIG. 9 is a cross sectional view taken along lines 9—9 of FIG. 7.

As further shown in FIG. 9, the cover 112 has a flat central surface 146 and an inverted U-shaped peripheral edge 148 displaying a depending skirt 150 having a circumferential inner bead 152 and a flat outwardly projecting lower edge 154. This lower edge is confined within the recessed area defined by the upper edge portion 116, the horizontal portion 132 of the flange and the upper vertical extension 136. The material of the cover is preferably an injection molded plastic so that the skirt 150 may be somewhat flexed to be forced into snap engagement with the peripheral upper edge 126 of the container with bead 152 engaging underneath bead 130.

In the side projection 139, there is formed a tab 162 which has a horizontal portion slightly spaced from the adjacent side wall of the container and from adjacent horizontal portions of the peripheral flange. As an alternative, there may also be provided a thin plastic connection between horizontal portion 132' of the side projection and its adjacent portions of the side walls and the flange.

Figure 10:
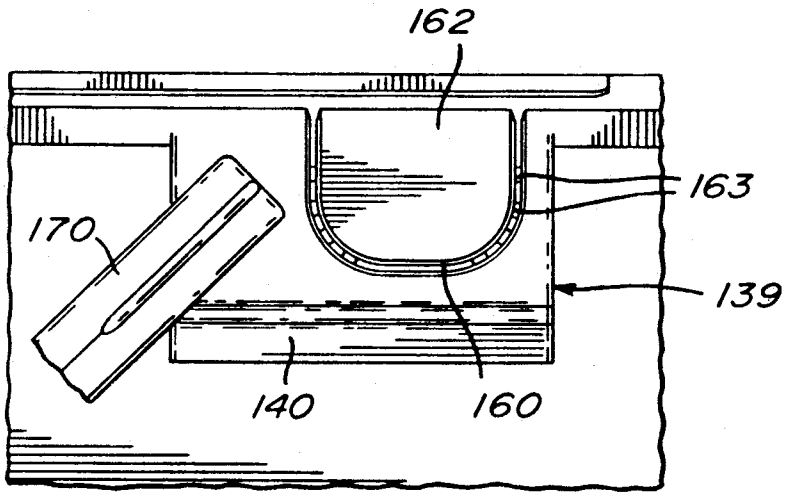
FIG. 10 is an enlarged view of the side projection of the container shown in FIG. 8.

As illustrated in FIG. 10, the front face of the side projections as a U-shaped outline 160 defined by a space between the tab 162 and the side projection 139. In the gap 160, there is provided a series of thin bridging portions 163 thus providing weakened areas which may be easily broken by pressing inwardly the tab 162.

Figure 11:
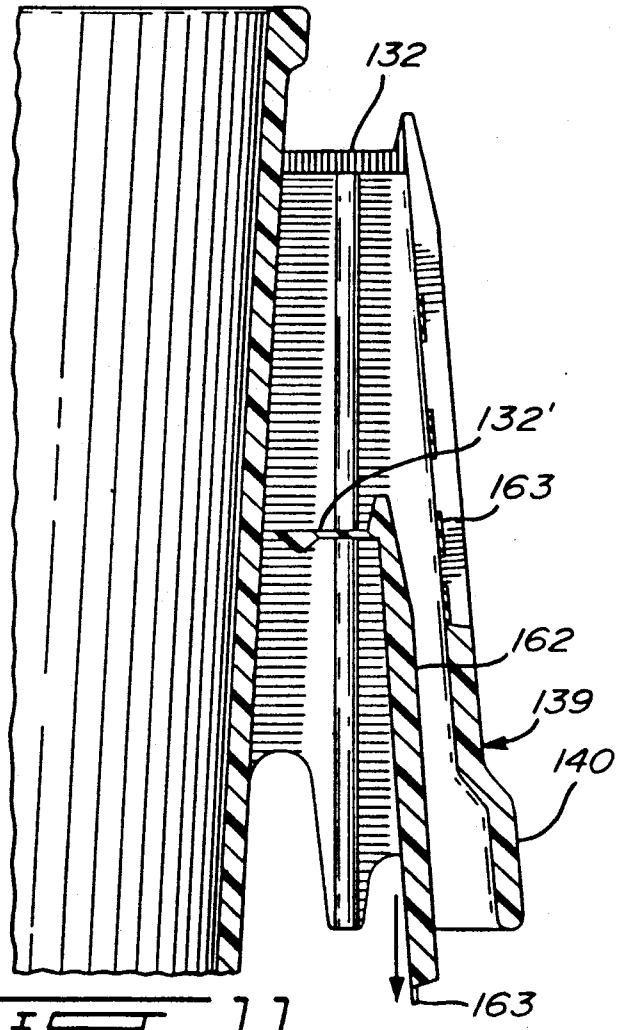
FIG. 11 is a cross sectional view showing the tab means removed from the side protection.

As illustrated in FIG. 9, to remove the cover securely engaged with the container, one must press on the tab 162 in the direction of arrows 161 to force it inwardly within the cavity defined behind the side projection, as shown by dotted lines 162', or in full lines as shown in FIG. 11 wherein the broken bridging portions 163 appear part on the falling tab 162 and part on the vertical portion of the side projection 139. In this position, the lower edge 154 of the cover may be manually grasped to be lifted to thereby remove the cover.

Figure 12:
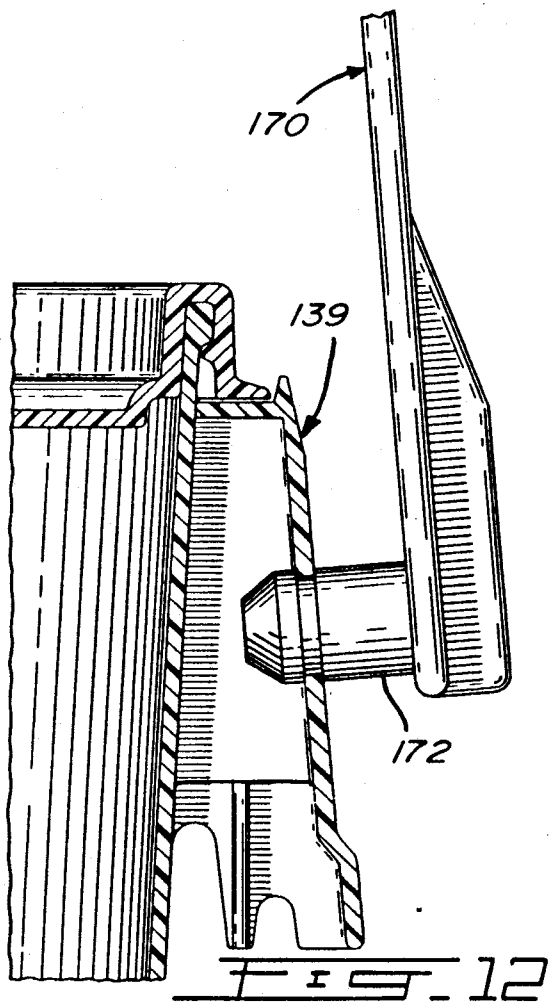
FIG. 12 is a cross sectional view taken along lines 12—12 of FIG. 7.

Referring to FIG. 12, a handle 170 has its opposite ends pivotally mounted at 172 to the vertical wall of the side projections 139 next to the tabs 162.

Preferably, the cover and the container of the present invention are made of injection moulded plastic material.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A container adapted to securely engage a cover displaying a peripheral depending skirt, comprising:

a body including side walls having an upper edge portion adapted to engage the peripheral depending skirt of a cover; said side walls including a peripheral flange consisting of a horizontal portion projecting outwardly from said side wall and of an outer vertical portion distanced from said side wall, said portions receiving in close relationship therewithin a lower part of said skirt; and a pair of opposite side projections each having a horizontal portion integrally formed with said side wall and with said horizontal portion of said flange and a downwardly extending vertical portion integrally formed with said vertical portion of said flange; tab means on said side projections being connected at least to said vertical portion of said flange through weakened areas to thereby render said tab means breakable when pressure is applied thereon thus providing visual indication of tampering, whether authorized or unauthorized, and allowing removal of the cover from the container.

2. A container as defined in claim 1, wherein said tab means having a horizontal portion slightly distanced from said side wall.

3. A container as defined in claim 1, wherein said weakened areas consists of a series of spaced thin bridging members.

4. A container as defined in claim 3, wherein said weakened areas are disposed in a U-shaped outline in said vertical portion.

5. A container as defined in claim 2, wherein said vertical portion of each side projection includes an outwardly projecting lower portion displaying recessed areas along lower edges thereof; said recessed areas including an outer recessed area in vertical alignment with said outer vertical portion of said flange to thereby receive therein an upper portion of the outer vertical portion of a flange of a lower similarly constructed container nested in said container.

6. A container as defined in claim 5, wherein said recessed areas include an inner recessed area in vertical alignment with the upper edge portion of the inclined side wall of the container to thereby receive therein the upper edge portion of the side wall of a similarly constructed container nested in said container.

7. A container as defined in claim 1, wherein the upper edge portion of said container contains, at least on portions thereof, external circumferential bead means adapted to be securely engaged with internal circumferential bead means on the skirt of said cover.

8. A container as defined in claim 1, wherein said container is formed of an injection-moulded plastic material.

9. A container as defined in claim 1, further comprising a handle having the opposite ends thereof pivotally engaged in said vertical portions of said side projections.

* * * * *